US005351770A

United States Patent [19]

Cawthorne et al.

[11] Patent Number: 5,351,770

[45] Date of Patent: Oct. 4, 1994

[54] ULTRA HARD INSERT CUTTERS FOR HEEL ROW ROTARY CONE ROCK BIT APPLICATIONS

[75] Inventors: Chris E. Cawthorne; Scott D. McDonough, both of The Woodlands; Gary Portwood, Katy; Michael A. Siracki, Spring, all of Tex.

[73] Assignee: Smith International, Inc., Houston, Tex.

[21] Appl. No.: 78,123

[22] Filed: Jun. 15, 1993

[51] Int. Cl.[5] ..... E21B 10/16

[52] U.S. Cl. ..... 175/374; 175/426; 175/431

[58] Field of Search ..... 175/374, 378, 408, 426, 175/431, 432, 433, 434, 428, 331

[56] References Cited

U.S. PATENT DOCUMENTS

| | | | |
|---|---|---|---|
| 4,148,368 | 4/1979 | Evans | 175/374 X |
| 4,203,496 | 5/1980 | Baker, III et al. | 175/432 |
| 4,940,099 | 7/1990 | Deane et al. | 175/374 |
| 5,131,480 | 7/1992 | Lockstedt et al. | 175/374 |
| 5,145,016 | 9/1992 | Estes | 175/374 X |
| 5,154,245 | 10/1992 | Waldenstrom et al. | 175/428 X |
| 5,199,832 | 4/1993 | Meskin et al. | 175/434 X |

*Primary Examiner*—David J. Bagnell
*Attorney, Agent, or Firm*—Robert G. Upton

[57] ABSTRACT

A rotary cone rock bit for drilling boreholes in an earthen formation is disclosed. One or more rotary cones are rotatively retained on a journal bearing connected to the rock bit. These rotary cones form a circumferential heel row with extended ultra hard shaped cutters spaced within the heel row. Each of the shaped cutters form a cutting surface that extends above the heel row or is angled with respect to the formation to maintain the cutters in compression while the cutters shear a borehole wall. The shaped cutters serve to maintain the borehole diameter.

24 Claims, 3 Drawing Sheets

FIG.1
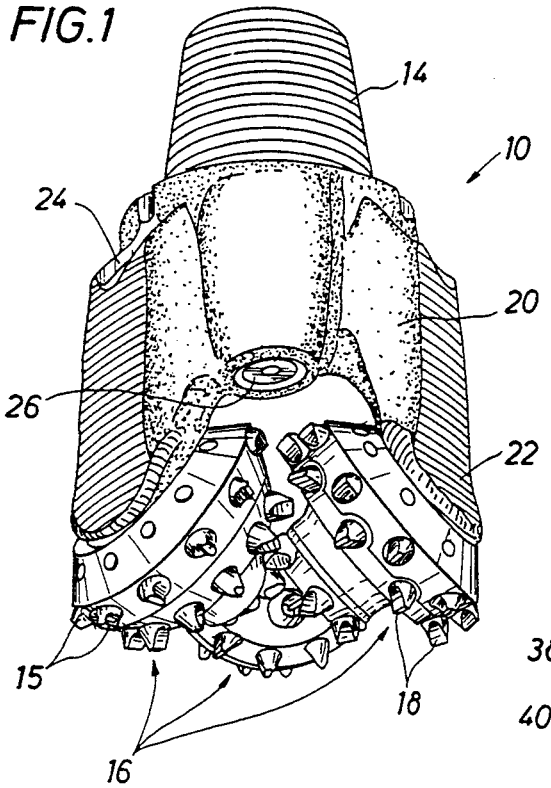
FIG.2
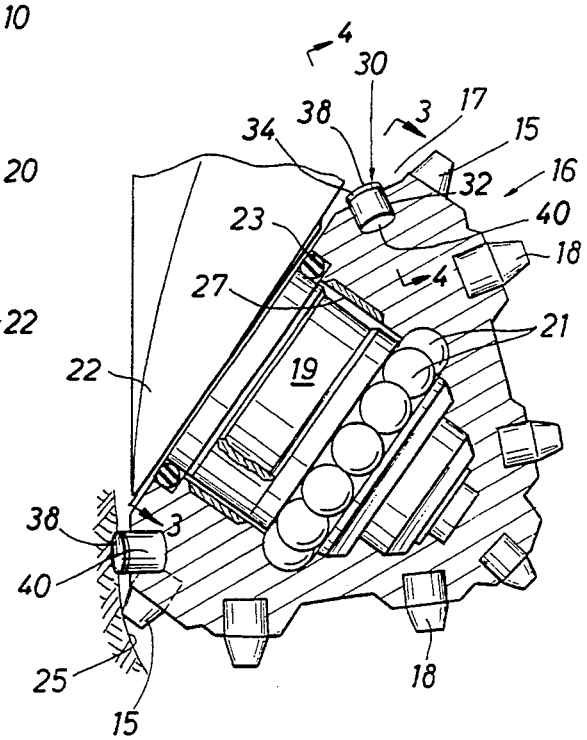
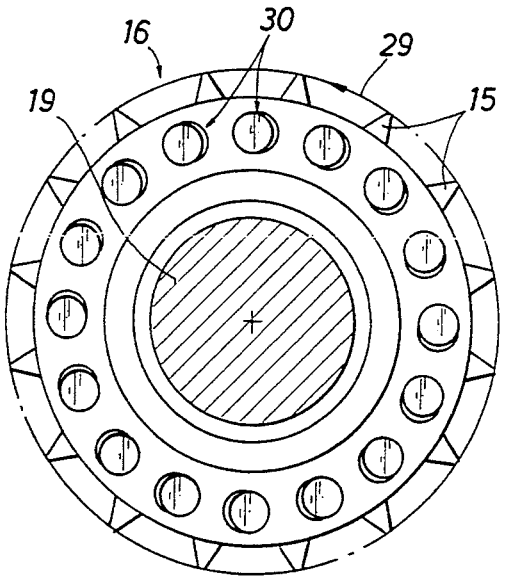
FIG.3
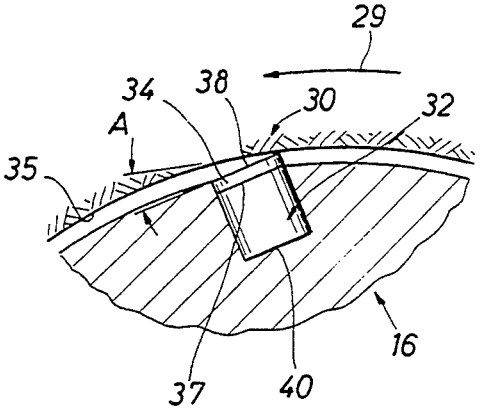
FIG.4

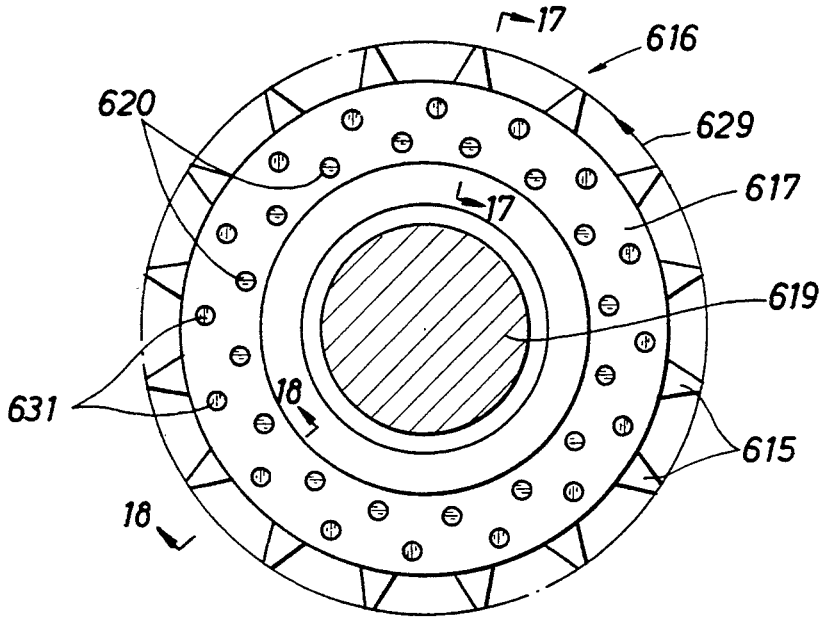
FIG. 16
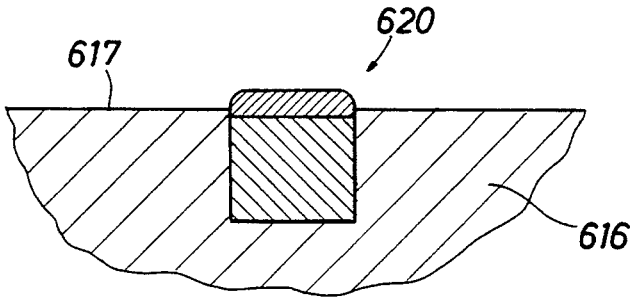
FIG. 18
FIG. 17
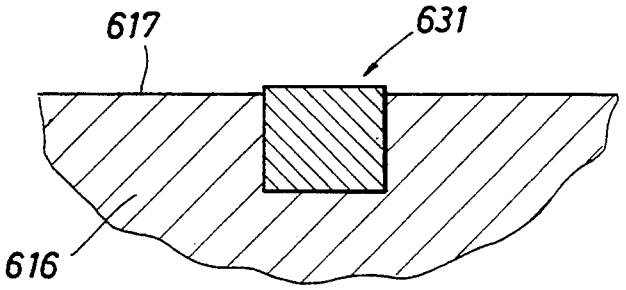

ULTRA HARD INSERT CUTTERS FOR HEEL ROW ROTARY CONE ROCK BIT APPLICATIONS

CROSS-REFERENCE TO RELATED APPLICATION

This invention relates to a patent application entitled ULTRA HARD INSERT CUTTERS FOR HEEL ROW ROTARY CONE ROCK BIT APPLICATION filed Jan. 8, 1993 Ser. No. 002,295.

BACKGROUND OF THE INVENTION

1. Field of the Invention

This invention relates to the cutting structure formed on rotary cones of rotary cone rock bits utilized to drill boreholes in an earthen formation.

More particularly, this invention relates to the use of shaped diamond or other ultra hard material insert cutters in the heel row of each of the rotary cones associated with the drill bit for maintaining the gage bore diameter of the formation. These ultra hard materials include cubic boron nitride and/or diamond/refractory metal carbide composites.

2. Description of the Prior Art

Diamond inserts in roller cone rock bits have been tried before in an attempt to extend the useful life of a rock bit as it works in a borehole.

U.S. Pat. No. 4,940,099 teaches the utilization of alternating tungsten carbide inserts and diamond inserts in each row formed on a rock bit cutter cone. Both the heel row and the gage row as well as successive concentric rows terminating at the apex of the truncated cone alternate tungsten carbide chisel inserts with diamond inserts. The heel row adjacent the cone mouth opening alternates flush mounted tungsten carbide inserts with harder tungsten carbide flush inserts with a layer of diamond bonded thereto. The alternating gage row inserts extend from the cone surface and serve to cut the gage of the borehole which of course determines the diameter of the drilled hole in the earthen formation.

It is well known in the art to utilize flush type inserts in the heel row of roller cones primarily to minimize erosion of the cones due to the passage of drilling fluid and formation detritus between the heel and gage rows of the cones and the borehole wall. The '099 patent, while it teaches alternating hard and soft flush inserts in the heel row also teaches that it is more important that the larger diameter rows, particularly the gage row, be provided with an intermingled pattern of soft and hard inserts to facilitate differing earthen formations.

Maintenance of a constant diameter borehole throughout the drilling operation is of paramount importance in controlling cost-per-foot drilling costs. If a rock bit should drill undergage it results in a following, same diameter bit to pinch due to the undersized hole condition. This usually results in a ruined rock bit and is the cause of another trip out of the hole followed by a reaming operation all of which is time consuming and very costly.

Flush type heel row inserts ultimately act as a passive bearing surface when the heel of the cone is in contact with the borehole wall. When the entire heel surface of each of the cones is in contact with the borehole wall, the cones are subjected to tremendous inthrust loads. The inthrust loads tend to pinch the bit, damage the cone and journal bearings and cause heat checking of the tungsten carbide inserts.

U.S. Pat. No. 5,131,480, assigned to the same assignee as the present invention and incorporated herein by reference, teaches the use of extended tungsten carbide inserts in a recessed heel row in a milled tooth rotary cone rock bit. While this patented feature greatly improved directional drilling capabilities, the rounded projections on the heel row inserts somewhat limited the rock shearing function necessary for aggressive side cutting while turning from a straight drill run.

It was found through experimentation that if drilling energy is not put into shearing the rock, the energy then converts into pushing the cone away from the rock formation resulting in the heretofore mentioned inthrust condition with all of its disadvantages.

SUMMARY OF THE INVENTION

It is an object of this invention to maintain the gage bore hole diameter for vertical drilling applications.

It is another object of this invention to utilize a hard wear material such as diamond cutter inserts that protrude from the heel row of each cone for maintenance of the borehole diameter.

A rotary cone rock bit for drilling boreholes in an earthen formation is disclosed wherein one or more rotary cones are rotatively retained on a journal bearing connected to a body of the rock bit. Each cone forms a circumferential heel row with extended ultra hard shaped cutters spaced within the heel row. Each of the shaped cutters form a surface that protrudes into the earthen formation as the rotary cone rotates against a bottom of the borehole formed by the formation. The shaped cutters serve to maintain the borehole diameter.

An advantage then of the present invention over the prior art is the use of shaped ultra hard cutters protruding from the heel row of a rotary cone rock bit to maintain the gage of a borehole during drilling operation.

The above noted objects and advantages of the present invention will be more fully understood upon a study of the following description in conjunction with the detailed drawings.

BRIEF DESCRIPTION OF THE DRAWINGS

FIG. 1 is a perspective view of a sealed bearing rotary cone rock bit;

FIG. 2 is a partially cut away cross-section of a roller cone mounted to a journal bearing;

FIG. 3 is an end view of the cone taken through 3—3 of FIG. 2 illustrating the heel surface of the cone and the orientation of each of the diamond cutters equidistantly placed around the heel row;

FIG. 4 is a view taken through 4—4 of FIG. 3 illustrating the orientation of one of the heel row inserts with the forward edge of the insert about even with the surface of the cone and the trailing edge of the insert protruding form the cone surface;

FIG. 16 is an end view of a roller cone with emphasis on the heel row of the cone illustrating staggered rows of flush type tungsten carbide near the outer diameter of the heel row with diamond heel row inserts strategically placed in the heel row between the beating cavity formed by the cone and the outer row of tungsten carbide inserts, FIG. 17 is a view taken through 18—18 of FIG. 17 illustrating a standard tungsten carbide flush type insert mounted in a heel surface of the cone, and FIG. 18 is a view taken through 19—19 of FIG. 17 illustrating a slightly raised diamond capped insert with a rounded edge such as shown in FIG. 13.

Figure 5:
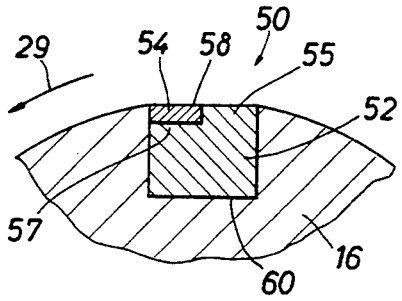
FIG. 5 is an alternative heel row insert for the insert depicted in FIG. 4, the insert being mounted substantially even with the surface of the cone, about one half of the circular cutting end of the insert is diamond and the other half is tungsten carbide, the diamond half being oriented toward the direction of rotation of the cone.

BRIEF DESCRIPTION OF THE PREFERRED EMBODIMENTS AND BEST MODE FOR CARRYING OUT THE INVENTION

Boreholes are commonly drilled with rock bits having rotary cones with cemented carbide inserts interference fitted within sockets formed by the cones. Such a rock bit generally designated as 10 has a steel body 20 with threads 14 formed at an upper end and three depending legs 22 at its lower end. Three cutter cones generally designated as 16 are rotatably mounted on three legs 22 the lower end of the bit body. A plurality of cemented tungsten carbide inserts 18 are press-fitted or interference fitted into insert sockets formed in the surface of the cones 16. Lubricant is provided to the journals 19 (FIG. 2) on which the cones are mounted from each of three grease reservoirs 24 in the body 20.

When the rock bit is used, it is threaded unto the lower end of a drill string and lowered into a well or borehole (not shown). The bit is rotated with the carbide inserts in the cones engaging the bottom of the hole. As the bit rotates, the cones 16 rotate on the bearing journals 19 or roller bearings (not shown) cantilevered from the body and essentially roll around the bottom of the hole 25 (FIG. 2). The weight of the bit is applied to the rock formation by the carbide inserts 18 and the rock is thereby crushed and chipped by the inserts. A drilling fluid is pumped down the drill string to the bottom of the hole and ejected from the bit body through nozzles 26. The drilling fluid then travels up the annulus formed between the outside drill pipe wall and the borehole formation walls. The drilling fluid provides cooling and removes the chips from the bottom of the borehole.

With reference now to FIG. 2, the lower portion of the leg 22 supports a journal bearing 19 on which cone 16 rotates. The cone is retained on the bearing 19 by a plurality of cone retention balls 21 confined by a pair of opposing ball races formed in the journal and the cone, The, cone forms annular heel row 17 positioned between the gage row inserts 15 and a bearing cavity 27 formed in cone 16, A multiplicity of protruding heel row insert cutters generally designated as 30 are about equidistantly spaced around the heel row 17, The protruding inserts 30 and the gage row inserts 15 coact to primarily cut the gage diameter of the borehole 25, The multiplicity of remaining inserts 18 in concentric rows crush and chip the earthen formation as heretofore described.

With reference now to FIGS. 3 and 4, each of the heel row cutters 30 is, for example, formed from a tungsten carbide body 32 having a base end 40 and a cutter end 38. End 38 supports an ultra hard cutter element 34 (preferably polycrystalline diamond) that is, for example, metallurgically bonded or brazed to the cutting end at juncture 37.

Each of the diamond inserts 30 is preferably interference fitted within insert retention sockets 31 formed in heel row 17 (FIG. 4).

The diamond material may be composed of polycrystalline material pressed in a super pressure press of the type taught in U.S. Pat. No. 4,604,106 assigned to the same assignee as the present invention and is incorporated herein by reference.

Moreover, the diamond cutters may be fabricated from a composite of tungsten carbide material impregnated with diamond particles (not shown). The process is set forth in U.S. Pat. Nos. 4,966,627 and 5,045,092, each of which is assigned to the same assignee as the present invention and is incorporated herein by reference.

Additionally, the previously described ultra hard inserts may be fabricated from composites of cubic boron nitride (CBN) and refractory metal carbides such as tungsten carbide.

Insert 30 consists of a full diamond disc the leading edge 33 of which is about flush or even with the heel surface 17 of cone 16. The trailing edge 35 extends above surface 17 and is exposed to the earthen formation 25. As the cone 16 is rotated in direction 29 by the drillstring, the diamond surface 38 is subjected to compressive forces by the formation 25. This angulation of the diamond cutting face 38 (5 to 25 degrees from the borehole wall 35) maintains the PCD disc in compression to reduce shear failures due to the thermal mismatch between the diamond disc 34 and the tungsten carbide insert body 32. The preferred angulation is 5 degrees (angle "A" FIG. 4).

Figure 6:
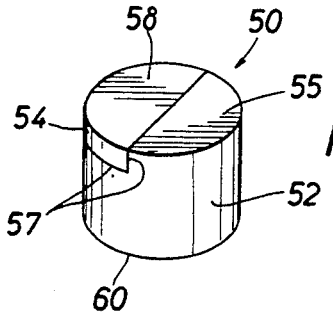
FIG. 6 is a perspective view of the insert shown in FIG. 5.

Referring now to FIGS. 5 and 6, an alternative heel row insert generally designated as 50 is retained within socket 31 formed in the heel row 17 of cone 16. The insert 50 consists of half a diamond disc 54 secured within recess 56 formed in surface 58 of body 52. The half diamond disc 54 is preferably bonded to body 52 at juncture 57 and 59. The backup support 55 formed by insert body 52 will allow the trailing edge 59 of the cutter 50 to be supported to prevent diamond cutter breakage due to elastic rebound of the formation against the cutters that often occurs during drilling operations.

Figure 7:
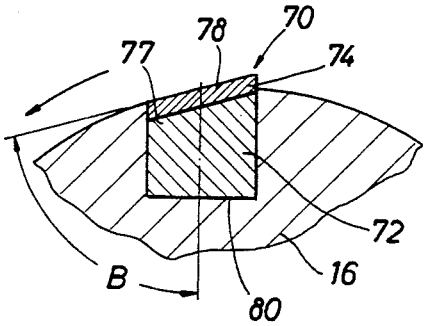
FIG. 7 is another alternative heel row insert for the insert depicted in FIG. 4 the top or cutting end of the cylindrical insert is cut at an oblique angle such that when the insert is positioned within a retention hole drilled in the cone substantially ninety degrees to the cone surface, a trailing edge portion of the diamond capped end of the insert extends beyond the surface of the cone when a leading edge of the insert is positioned toward the direction of rotation of the cone.
Figure 8:
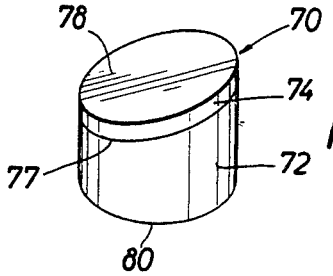
FIG. 8 is a perspective view of the insert shown in FIG. 7.

FIGS. 7 and 8 illustrate still another alternative embodiment wherein the socket 31 in the cone 16 is aligned radially from an axis of the cone and the insert generally designated as 70 forms an angled surface 78 with respect to an axis of the insert body 72. The angled surface (angle "B" FIG. 7) is from 70 to 85 degrees from the axis of the insert. Diamond disc 74 is oriented with its leading edge 73 substantially even or flush with heel surface 17 and the trailing edge 75 extending above the surface 17 similar to the insert 30 shown in FIGS. 2, 3 and 4. An insert so configured might be needed where cone material to support the heel row inserts is at a premium. For example, the insert 30 in FIGS. 2, 3 and 4 requires that the socket 31 be drilled at an angle to a radial line from an axis of the cone 16. In this example, each insert 30 necessarily takes up more room in the heel surface thus less of the heel row inserts may be utilized as a result. Hence the insert 70 with the desired cutter disc angulation might be preferred since, because of the radial orientation, of the sockets 31, there would be more room for additional inserts in the heel row 17.

Figure 9:
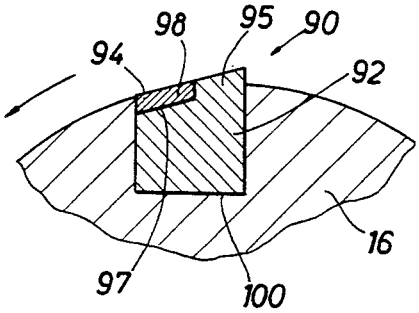
FIG. 9 is a variation of the insert described with respect to FIGS. 7 and 8 wherein the leading edge half of the slanted top of the insert is diamond the raised trailing edge is tungsten carbide.
Figure 10:
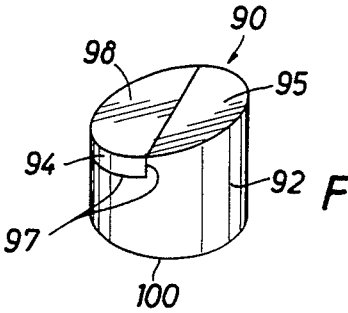
FIG. 10 is a perspective view of the insert shown in FIG. 9.

FIGS. 9 and 10 depict a variation of insert 70. Insert generally designated as 90 consists of half a disc 94 that is similar in fabrication to insert 50 except that the cutter surface is angled with respect to a axis of the insert body 92.

Figure 11:
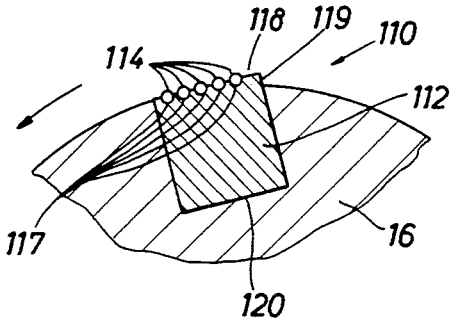
FIG. 11 is yet another alternative heel row insert that may be used in place of the insert shown in FIG. 4 wherein the cutting surface of the insert comprises a layer of either natural or synthetic diamond particles imbedded in a matrix of a tungsten carbide or mechanically attached to the surface of a tungsten carbide cylindrical stud.
Figure 12:
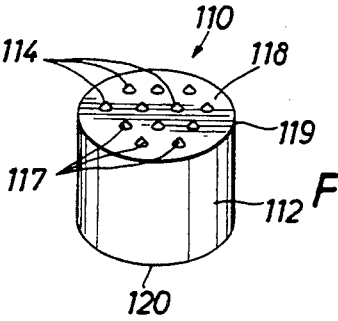
FIG. 12 is a perspective view of the insert shown in FIG. 11.

The heel row insert 110 depicted in FIGS. 11 and 12 consists of a tungsten carbide body 112, the surface 118 of which supports a multiplicity of natural or synthetic diamonds cutters 114. The diamond particles 114 may be metalurgically or mechanically secured (117) to surface 118 by state of the art methods. Alternatively, the diamond particles may retained within a matrix of tungsten carbide. In this example, the natural or synthetic diamonds are normally set within a depression formed in an insert mold followed by the insertion of a matrix of tungsten carbide powder and a binder such as cobalt into the mold. The insert is subsequently sintered in a furnace (not shown).

As earlier illustrated and described, the trailing edge 119 of the insert 110 extends beyond surface 17 of insert 16, an axis of the body 112 being angularly displaced from a radial line from an axis of the cone.

FIGS. 13, 14, 15 and 16 are variations on flush type diamond heel row inserts.

Figure 13:
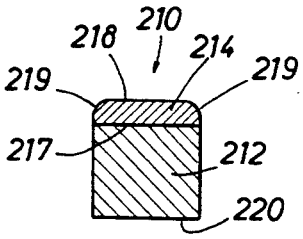
FIG. 13 is a diamond capped cylindrical heel row insert with the diamond cutting edge rounded.

The insert 210 of FIG. 13 is crowned with a synthetic diamond cap 214 bonded to body 212 at junction 217 or the layer of diamond may be a transition layer of diamond and tungsten carbide as heretofore described. In this example the comers 219 of diamond cap 214 are essentially one quarter round. The rounded corners are less apt to chip when in operation in a borehole.

The insert may be mounted within the heel row 17 of cone 16 either radially aligned (see FIG. 5) or aligned at an angle to a radial line with respect to an axis of the cone as is shown in FIGS. 2 thru 4.

Figure 14:
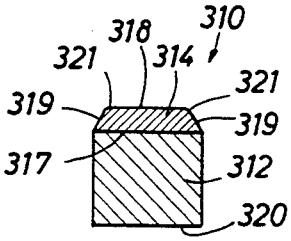
FIG. 14 is a diamond capped cylindrical heel row insert with the diamond cutting edge chamfered, the cutting edge at the end of the chamfered diamond being slightly rounded.

FIG. 14 is another insert 310 with the diamond rim 319 chamfered. The cutting edge 321 however is rounded again to minimize chipping of the diamond at the comer 321 transitioning between the chamfered rim 319 and the flat top surface 318.

Figure 15:
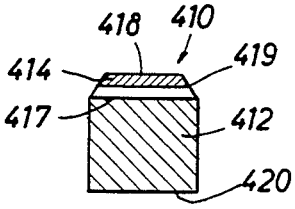
FIG. 15 is a diamond capped cylindrical heel row insert, the chamfered diamond cutting end being smaller in diameter than the diameter of the cylindrical body.

The insert 410 shown in FIG. 15 is also chamfered except that the diamond cap 414 does not cover the entire cutting end of the insert. In other words, the diamond is kept off of the outside diameter of the insert. This would be of no consequence where the insert is inserted in an insert socket formed in a cone such that the O.D. corner of the chamfer at the cutting end 418 of the insert is below the heel row surface 17 of cone 16 (not shown).

FIG. 16 is a view of the back or heel surface 617 of cone 616. This view is similar to the previously described in FIG. 3 except that there two rows of inserts in heel surface 617. The row of inserts 620 nearest the journal bearing 619 (shortest radial distance from an axis of the cone) are diamond inserts of the type described in FIG. 13. The outer row of inserts 631 in the heel surface 617 and nearest the gage row inserts 615 preferably comprise an insert fabricated from ultra hard material that is tougher than the row of diamond inserts. Tungsten carbide inserts of various grades of hardness are examples of such inserts 631.

The purpose of the double row of inserts in heel surface 617 is to utilize the tougher inserts 631 to bring the borehole to full or near full gage prior to the engagement of the diamond inserts 620 to put less work on the diamonds thus preserving the life of the diamonds resulting in a more prolonged maintenance of the borehole diameter during drilling operations. This is possible since tungsten carbide is tougher than diamond.

FIG. 17 depicts the insert 631 which may be positioned slightly above the surface 617 as is shown in the drawing.

FIG. 18 illustrates the diamond cutter 620 with the rounded comers as depicted in FIG. 13. It should be noted that the diamond cap of the insert is protected at the juncture to the carbide stud body by inserting the insert deeper into its retention socket formed in cone 616.

It would be obvious to use any of the insert cutter designs shown in FIGS. 13 through 15 in place of the insert 30 shown in FIGS. 1 through 4.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A rotary cone rock bit for drilling in an earthen formation comprises one or more rotary cones rotatively retained on a bearing connected to a body of said rock bit, each cone forms a circumferential heel row with diamond inserts spaced within said heel row, each of said diamond inserts forms a first exposed polycrystalline diamond surface that is about adjacent to said formation, said diamond insert is a right angle cylindrical body, an edge formed by said cylinder at said exposed diamond surface is chamfered, an edge formed by said chamfer nearest said exposed polycrystalline diamond surface of said insert is radiused to reduce cracking and chipping of the diamond, said inserts serve to maintain a constant diameter borehole wall formed by said formation as said rotary cone rotates against a bottom of said borehole.

2. The invention as set forth in claim 1 wherein a portion of said chamfered surface and said exposed surface is covered by said diamond, said diamond being separated from a cylindrical wall formed by said insert body.

3. The invention as set forth in claim 1 wherein said exposed surface of said right angle cylindrical body insert is about half diamond the remaining half of said exposed surface is an ultra hard material forming said insert body, said diamond portion of said insert is oriented toward a direction of rotation of said rotary cone.

4. The invention as set forth in claim 3 wherein said ultra hard material forming said body is tungsten carbide.

5. The invention as set forth in claim 1 wherein said exposed diamond surface of said insert is comprised of individual diamond segments imbedded in said surface.

6. The invention as set forth in claim 5 wherein said individual diamond segments are natural diamond.

7. The invention as set forth in claim 5 wherein said individual diamond segments are polycrystalline diamond.

8. The invention as set forth in claim 1 wherein said right angle cylindrical insert bodies are fabricated from composites of cubic boron nitride and tungsten carbide.

9. The invention as set forth in claim 1 wherein said right angle cylindrical insert bodies are fabricated from composites of diamond and tungsten carbide.

10. A rotary cone rock bit for drilling boreholes in earthen formation comprises one or more rotary cones rotatively retained on a bearing connected to a body of said rock bit, each cone forming a circumferential heel row, with extended inserts spaced within said heel row, each of said inserts forms a first diamond cutting surface that is angled with respect to the formation to maintain the inserts in compression, a leading edge formed by said diamond surface of said insert being further away from the formation than a trailing edge formed by the diamond surface of said insert, the diamond heel row inserts with their angled cutting surface serve to maintain a substantially constant borehole diameter as the rotary cone rotates against a bottom of said borehole.

11. The invention as set forth in claim 10 wherein the extended insert is a right angle cylindrical body, said cutting surface being perpendicular to an axis of the body, said first diamond cutting surface is formed from polycrystalline diamond.

12. The invention as set forth in claim 11 wherein said edge formed by said cylinder at said exposed diamond surface is radiused.

13. The invention as set forth in claim 11 wherein said edge formed by said cylinder at said exposed diamond surface is chamfered, an edge formed by said chamfer nearest said exposed diamond surface of said insert is radiused.

14. The invention as set forth in claim 13 wherein a portion of said chamfered surface and said exposed surface is covered by said diamond, said diamond being separated from a cylinder wall formed by said insert body.

15. The invention as set forth in claim 10 wherein said extended insert is a right angle cylindrical body, said diamond cutting surface is about half diamond the remaining half of said cutting surface is an ultra hard material forming said insert body, said diamond portion of said insert is oriented toward a direction of rotation of said rotary cone.

16. The invention as set forth in claim 15 wherein said ultra hard material forming said body is tungsten carbide.

17. The invention as set forth in claim 16 wherein said diamond cutting surface of said insert is comprised of individual diamond segments imbedded in said surface.

18. The invention as set forth in claim 17 wherein said individual diamond segments are natural diamond.

19. The invention as set forth in claim 17 wherein said individual diamond segments are polycrystalline diamond.

20. The invention as set forth in claim 10 wherein a body of said extended insert is fabricated from composites of cubic boron nitride and tungsten carbide.

21. The invention as set forth in claim 20 wherein said body of said extended insert is fabricated from composites of diamond and tungsten carbide.

22. The invention as set forth in claim 16 wherein the diamond cutting surface is oblique to an axis of the cutter insert body.

23. The invention as set forth in claim 10 wherein an angle formed between the diamond cutting surface and a wall formed by said formation is between five and twenty five degrees with a leading edge formed by said cutting face being further away from said wall than a trailing edge formed by said diamond cutting surface.

24. A rotary cone rock bit for drilling boreholes in an earthen formation comprises one or more rotary cones rotatively retained on a bearing connected to a body of said rock bit, each cone forming a circumferential heel row with two or more rows of heel inserts on different radial distances from a cone axis, at least one row contains diamond faced inserts, said diamond faced inserts being on a shorter radial distance than another heel row containing inserts formed from tougher ultra hard material.

* * * * *